US007116274B2

(12) United States Patent
Huang et al.

(10) Patent No.: US 7,116,274 B2
(45) Date of Patent: Oct. 3, 2006

(54) PLANAR INVERTED F ANTENNA

(75) Inventors: Wen-Man Huang, Hsinchu (TW); Shiau-Ting Huang, Hsinchu (TW)

(73) Assignee: Z-Com, Inc., Hsinchu (TW)

( * ) Notice: Subject to any disclaimer, the term of this patent is extended or adjusted under 35 U.S.C. 154(b) by 0 days.

(21) Appl. No.: 11/041,208

(22) Filed: Jan. 25, 2005

(65) Prior Publication Data

US 2006/0164304 A1 Jul. 27, 2006

(51) Int. Cl.
*H01Q 1/38* (2006.01)
*H01Q 1/24* (2006.01)
*H01Q 13/12* (2006.01)

(52) U.S. Cl. ..... 343/700 MS; 343/702; 343/769

(58) Field of Classification Search ..... 343/700 MS, 343/702, 767, 769, 770, 846, 848, 860
See application file for complete search history.

(56) References Cited

U.S. PATENT DOCUMENTS 6,346,914 B1 * 2/2002 Annamaa ..... 343/700 MS
6,498,586 B1 * 12/2002 Pankinaho ..... 343/700 MS
6,781,547 B1 8/2004 Lee
6,795,028 B1 9/2004 Stutzman et al.
2004/0061652 A1 * 4/2004 Ishihara et al. ..... 343/752

* cited by examiner

*Primary Examiner*—Shih-Chao Chen
(74) *Attorney, Agent, or Firm*—Birch, Stewart, Kolasch and Birch, LLP

(57) ABSTRACT

A planar inverted F antenna includes a radiation portion to receive or transmit a radio signal, a short portion having one end connecting to the radiation portion to brace the radiation portion, a ground portion connecting to the short portion on another end, and a feed section located between the radiation portion and the ground portion, wherein the feed section has one end connecting to the radiation portion and another end directed towards the ground portion but not connected to the ground portion. The radiation portion, short portion, ground portion and feed section are formed in an integrated manner.

26 Claims, 14 Drawing Sheets

Antenna Gain Pattern (dBi) vs Theta at 2450 MHz, surface=facesl

Antenna Gain Pattern (dBi) vs Theta at 2500 MHz, surface=facesl

PLANAR INVERTED F ANTENNA

BACKGROUND

1. Field of the Invention

The invention relates to a monopole antenna, and particularly to a planar inverted F antenna fabricated in an integrated manner and adopted for use on a wireless communication device to provide high antenna performance for the wireless communication device.

2. Description of the Related Art

With the wireless communication industry is expanding in recent years, wireless communication technologies have become widely used in a great number of high-tech products. Nowadays proliferations of wireless communication products are available on the market. The prevailing trend in wireless communication products is slim and light without compromising performance to meet consumers' requirements of high quality. Hence the antenna that transmits and receives signals for wireless communication products is an important item in research and development.

The commonly used antennas include dipole antennas, helix antennas, planar inverted F antennas (PIFA), microstrip antennas and the like. The PIFA can achieve impedance matching without adding inductance and capacitance, thus it is widely used.

Refer to FIG. 1 for a PIFA 100, as disclosed in U.S. Pat. No. 6,795,028 B2, includes a first conductive blade 110, a second conductive blade 120, a short blade 130, a feed blade 140 and a feed connector 150. The first conductive blade 110 is the main radiation portion. The second conductive blade 120 is grounded and has a length slightly greater than that of the first conductive blade 110 but with a width no larger than that of the first conductive blade 110. The short blade 130 bridges one end of the first and second conductive blades 110 and 120, and has a width slightly smaller than that of the first and second conductive blades 110 and 120. The feed blade 140 is located between the first and second conductive blades 110 and 120, and has a width the same as the first and second conductive blades 110 and 120 but with a length slightly smaller than that of the first conductive blade 110. The feed blade 140 has one edge connecting to an edge of the first conductive blade 110 to form a line. Hence another edge of the feed blade 140 is spaced from the short blade 130 at a small distance. The feed connector 150 has a center conductor 152 running through the second conductive blade 120 to brace the feed blade 140. The feed blade 140 and the first and second conductive blades 110 and 120 are parallel with one another. The short blade 130 and the feed connector 150 are normal to the feed blade 140 and first and second conductive blades 110 and 120. Thus when the antenna is in operation, the feed blade 140 and the second conductive blade 120 create a capacitance effect to feed capacitance to the first conductive blade 110.

FIG. 2 illustrates another PIFA disclosed in U.S. Pat. No. 6,781,547 B2. The antenna 200 is formed on an upper surface of a substrate 250 and includes a round opening 252, a slot 254, two radiation conductive wires 210 and 212, and a straight radiation conductive wire 214. The straight radiation conductive wire 214 has a feed point 240 on one end not connecting to the radiation conductive wire 212. The two radiation conductive wires 210 and 212 have a plurality of apertures 256 evenly formed thereon and they run through the substrate. The apertures 256 may also be formed on the straight radiation conductive wire 214 if necessary. The round opening 252, slot 254 and apertures 256 can increase the bandwidth and gain of the antenna 200. In addition, the substrate 250 may be a printed circuit board. The substrate 250 has a lower surface made from a conductive material to become a ground surface 220. The ground surface 220 may be located beneath the radiation conductive wire 210 and a portion of the straight radiation conductive wire 214 (e.g., one half of the straight radiation conductive wire 214).

While the conventional antenna can be shrunk without reducing its performance, the fabrication cost is still high and fabrication is difficult. To produce a low cost antenna with high performance and a simple fabrication process is still an issue continuously pursued in the industry.

SUMMARY

The primary object of the invention is to provide a planar inverted F antenna to solve the disadvantages occurring with the conventional techniques.

In one aspect, the planar inverted F antenna according to the invention is formed with a conductive thin metal sheet that can be installed firmly and easily and connected to a transmission circuit of a wireless communication device.

In another aspect, the planar inverted F antenna according to the invention adopts a substantially circular design, is shrunk without reducing antenna performance, and maintains a relatively high antenna performance for a wireless communication device even if the connecting area with the transmission circuit of the wireless communication device is reduced.

The planar inverted F antenna according to the invention is formed with metal in an integrated manner. Thus fabrication is simpler and easier.

To achieve the foregoing object, the planar inverted F antenna according to the invention includes a radiation portion, a short portion, a ground portion and a feed section. The radiation portion aims to receive or transmit radio signals. The short portion has one end connecting to the radiation portion to brace the radiation portion. The ground portion is connected to another end of the short portion. The feed section is located between the radiation portion and the ground portion. The feed section has one end connecting to the radiation portion and another end directing towards the ground portion but does not connect to the ground portion.

The radiation portion, short portion, ground portion and feed section are formed in an integrated manner.

The radiation portion has a first opening. The planar inverted F antenna further has a match portion located in the first opening of the radiation portion. The match portion has two ends connecting to the radiation portion. The first opening is greater than the match portion.

The match portion includes two connecting portions with one end connecting to the radiation portion and a zigzag portion with two ends connecting respectively to another end of the connecting portion. The connecting portion and the zigzag portion are formed with a conductive thin metal sheet. The connecting portions may be one or more metal conductors.

The planar inverted F antenna may further include an anchoring portion made from an insulation material and formed cylindrically with a length slightly greater than the short portion to brace the radiation portion. The anchoring portion includes a cylindrical body about the same length as the short portion and two insetting portions connecting respectively to two ends of the body.

The radiation portion and the ground portion have respectively a fourth opening and a fifth opening. The two insetting portions are inset respectively in the fourth and fifth openings to enable the antenna to be installed securely on the wireless communication device. In addition, the fourth and fifth openings are located respectively on one side of the radiation portion and the ground portion remote from the short portion.

The radiation portion, short portion, ground portion and feed section are formed with a conductive thin metal sheet. The radiation portion and the ground portion are formed in the same shape and are substantially circular. However, the radiation portion and the ground portion may also be formed in other geometric shapes proximate to a circle.

The short portion has a second opening to divide the short portion into two sections. Each section has one end connecting to the radiation portion and another end connecting to the ground portion.

The ground portion has a third opening corresponding to the feed section but greater than the feed section to allow the feed section to run through the ground portion without coming into contact with the ground portion. Hence when the ground portion is anchored on a circuit board of the wireless communication device, the feed section may be connected electrically to the transmission circuit of the wireless communication device.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings, which are given by way of illustration only, and thus are not limitative of the present invention, and wherein.

DESCRIPTION OF THE PREFERRED EMBODIMENTS

Figure 1:
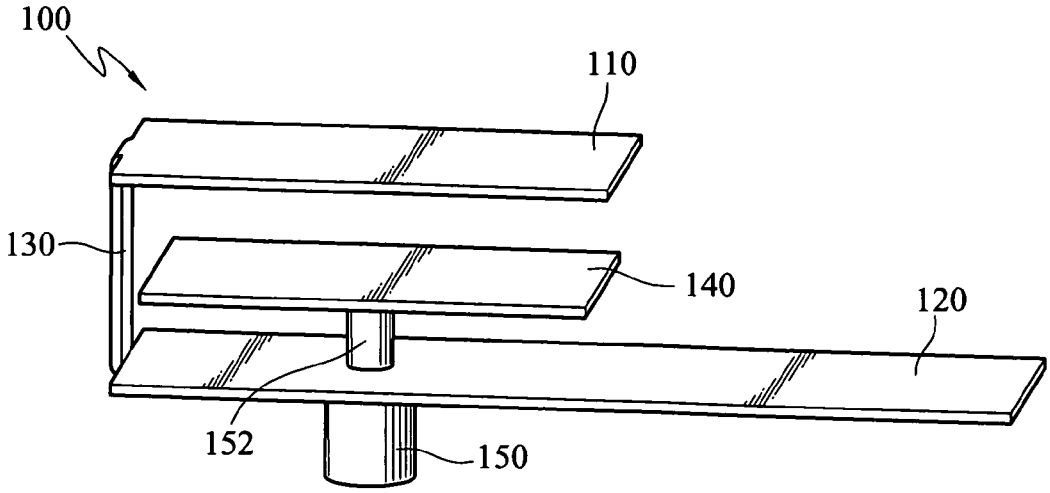
FIG.1 (PRIOR ART)
FIG. 1 is a perspective view of a conventional PIFA.
Figure 2:
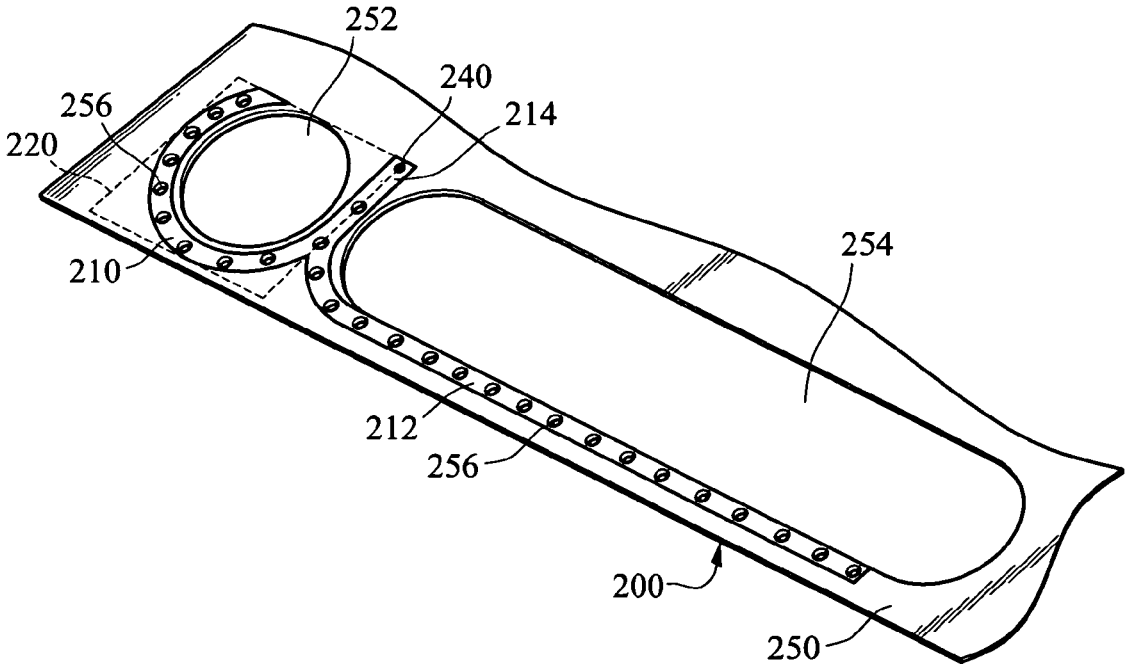
FIG.2 (PRIOR ART)
FIG. 2 is a perspective view of another conventional PIFA.
Figure 3:
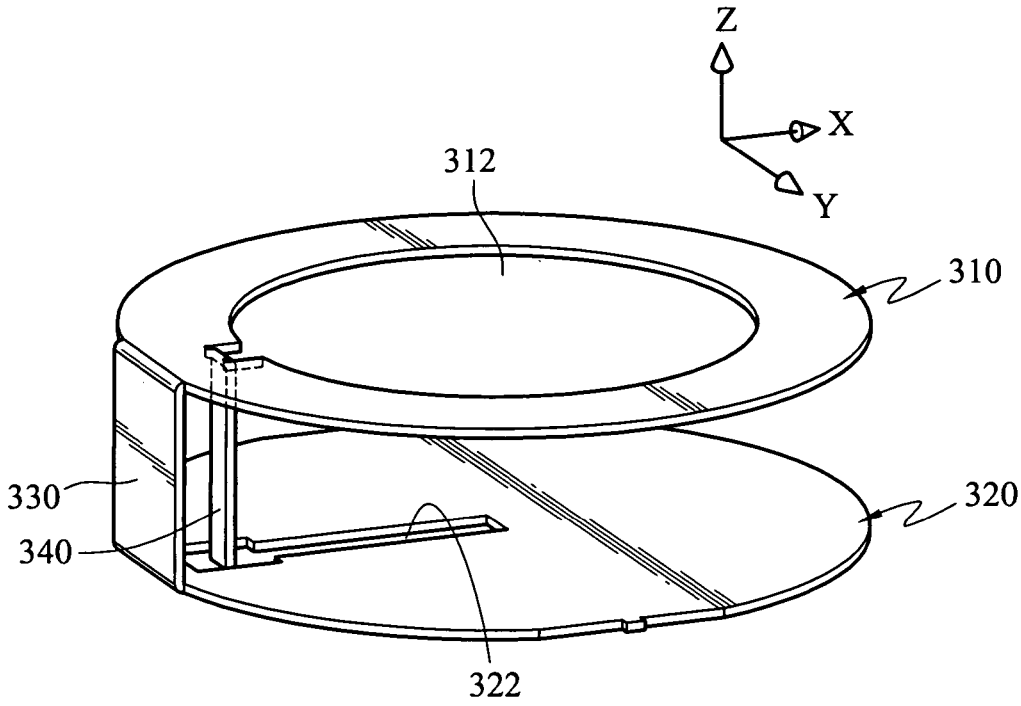
FIG. 3 is a perspective view of a PIFA according to a first embodiment of the invention.

Refer to FIG. 3 for a first embodiment of the planar inverted F antenna (PIFA) of the invention adopted for use on a wireless communication device. It includes a radiation portion 310, a ground portion 320, a short portion 330 and a feed section 340.

The radiation portion 310 aims to receive or transmit radio signals for the wireless communication device.

The ground portion 320 is securely mounted onto the wireless communication device by soldering or bonding (through double-sided adhesive tape or Velcro strips).

The short portion 330 bridges the radiation portion 310 and the ground portion 320, braces the radiation portion 310, and spaces the radiation portion 310 from the ground portion 320 at a small distance. In this embodiment the short portion 330 forms an included angle with the radiation portion 310 and the ground portion 320 of about 90 degrees. Hence the radiation portion 310 is substantially in parallel with the ground portion 320.

The feed section 340 is located between the radiation portion 310 and the ground portion 320. The feed section 340 has one end connecting to the radiation portion 310 and another end directed towards the ground portion 320 without connecting to the ground portion 320 to transmit signals between the antenna and the wireless communication device. In this embodiment the feed section 340 forms an included angle with the radiation portion 310 and the ground portion 320 of about 90 degrees.

The radiation portion 310, ground portion 320, short portion 330 and feed section 340 are formed with a conductive thin metal sheet such as nickel, copper or the like.

The planar inverted F antenna of the invention may be formed in an integrated manner. Namely the radiation portion 310, ground portion 320, short portion 330 and feed section 340 may be directly fabricated and formed through a thin metal sheet.

The radiation portion 310 and the ground portion 320 are formed in a similar shape and are substantially circular, oval, or other geometric shapes.

The short portion 330 is a conductor formed substantially as a rectangle having two ends connecting respectively to the radiation portion 310 and the ground portion 320 (or a square, rectangle or polygon with four sides and four smooth corners). The short portion 330 may also be formed in other geometric shapes with two ends connecting respectively to the radiation portion 310 and the ground portion 320.

The feed section 340 is a narrow and elongated conductor formed substantially as a rectangle with one end connecting to the radiation portion. The feed section 340 may also be formed in other geometric shapes with one end connecting to the radiation portion.

Moreover, the feed section 340 may also be formed from the radiation portion 310. Hence the radiation portion 310 has a first opening 312 larger than the feed section 340. The first opening 312 is substantially rectangular, circular or other geometric shape.

The ground portion 320 has a second opening 322 corresponding to the feed section 340 to prevent the feed section 340 from connecting to the ground portion 320 and resulting in a short circuit. That is, the second opening 322 is larger than the corresponding feed section 340. The second opening 322 may be substantially rectangular, circular or other geometric shape.

Figure 4:
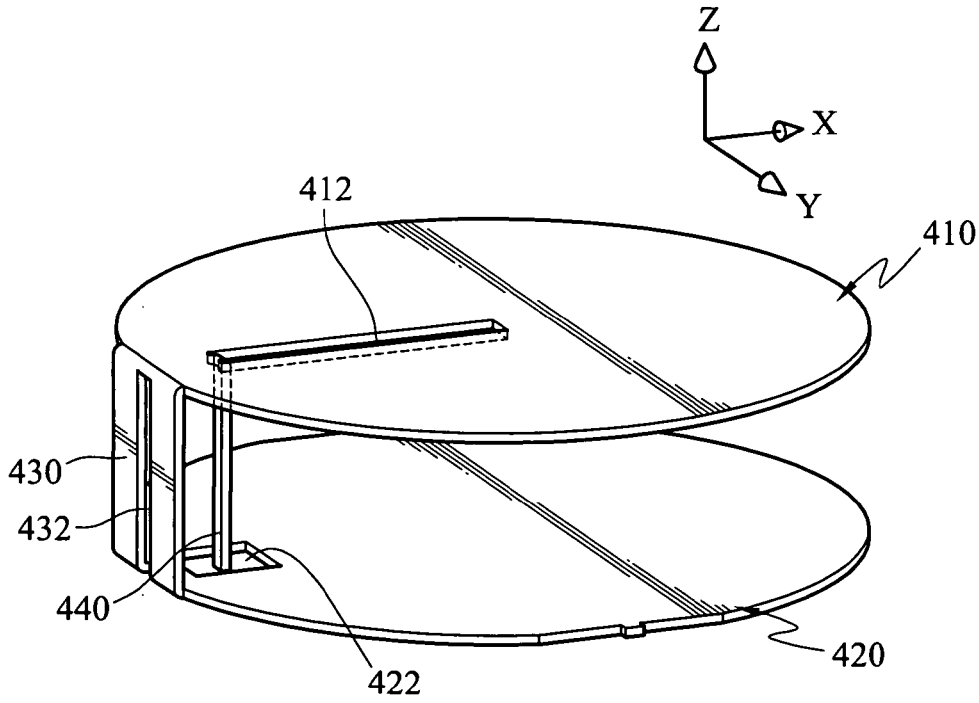
FIG. 4 is a perspective view of the PIFA according to a second embodiment of the invention.

Refer to FIG. 4 for the PIFA according to a second embodiment of the invention, and it includes a radiation portion 410, a ground portion 420 and a short portion 430. As the ones set forth above, the radiation portion 410 has a first opening 412, and the ground portion 420 has a second opening 422. A short portion 430 has a third opening 432 to enable one end of a conductive wire to run through and connect electrically to a feed section 440. The conductive wire has another end connecting electrically to a transmission circuit of a wireless communication device. While the conductive wire is connected electrically to the feed section 440, it must not make contact with the short portion 430, or the conductive wire must be shielded by an insulation layer. The conductive wire may be a coaxial cable. The third opening 432 is a slot or other geometric shape. In this embodiment the third opening 432 divides the short portion 430 into two sections, namely, two thin metal sheets. Each section has one end connecting to the radiation portion and another end connecting to the ground portion. In addition, if the ground portion 420 has a third opening 432, the third opening 432 may be extended to the ground portion 420 to connect to the second opening 422 to facilitate fabrication.

Figure 5:
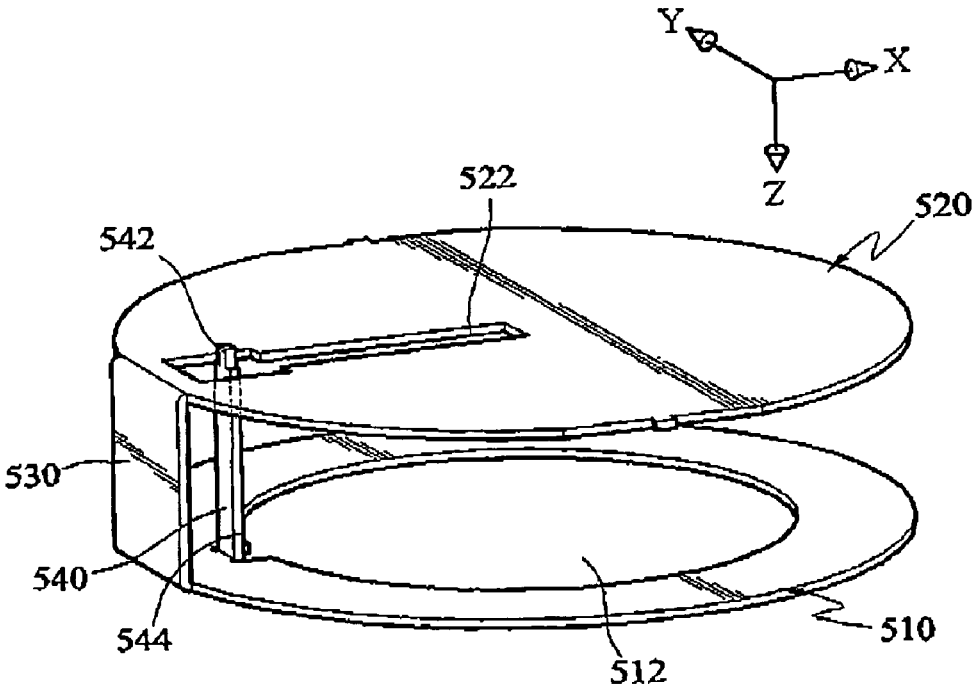
FIG. 5 is a perspective view of the PIFA according to a third embodiment of the invention.

Refer to FIG. 5 for a third embodiment of the PIFA of the invention. It includes a radiation portion 510, a ground portion 520 and a short portion 530 that are substantially constructed as the ones set forth above, thus details are omitted, wherein the radiation portion 510 has a first opening 512, and the ground portion 520 has a second opening 522. The ground portion 520 has a second opening 522 corresponding to a feed section 540 but which is larger than the feed section 540 to prevent the feed section 540 from coming in contact with the ground portion 520 and creating a short circuit. Moreover, if the feed section 540 is long enough, it can pass through the ground portion 520 without coming into contact therewith. Hence when the ground portion 520 is coupled on a circuit board of a wireless communication device, the feed section 540 is connected electrically to the transmission circuit of the wireless communication device.

In addition, a passing through portion 542 of the feed section 540 that runs through the ground portion 520 may have a width smaller than the other portion 544 thereof to form a jutting end to be wedged easily in the transmission circuit of the wireless communication device.

Figure 6:
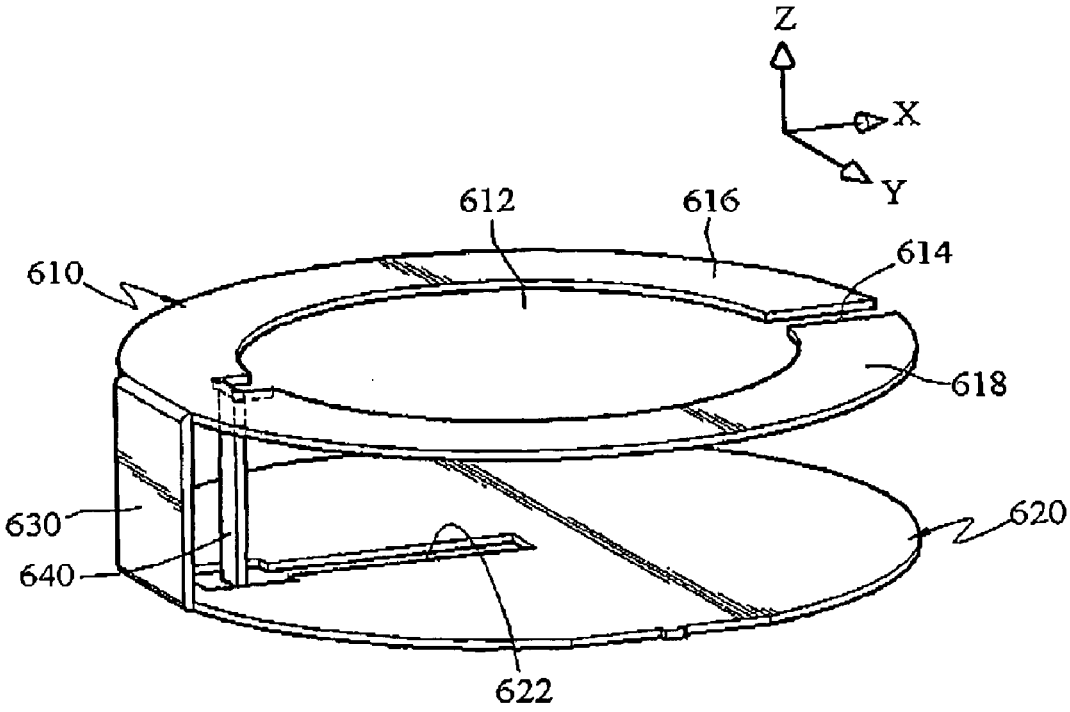
FIG. 6 is a perspective view of the PIFA according to a fourth embodiment of the invention.

Refer to FIG. 6 for the PIFA according to a fourth embodiment of the invention. It includes a ground portion 620, a short portion 630 and a feed section 640 that are substantially constructed as the ones set forth above, thus details are omitted, wherein the radiation portion 610 has a first opening 612, and the ground portion 620 has a second opening 622.

However, a radiation portion 610 has a first opening 612 formed symmetrically, e.g., proximate to a circle. There is a slit 614 on one side opposing the short portion 630 so that the radiation portion 610 forms two symmetrical sections 616 and 618 that are two semi-circular shapes corresponding to each other as shown in FIG. 6.

Figure 7:
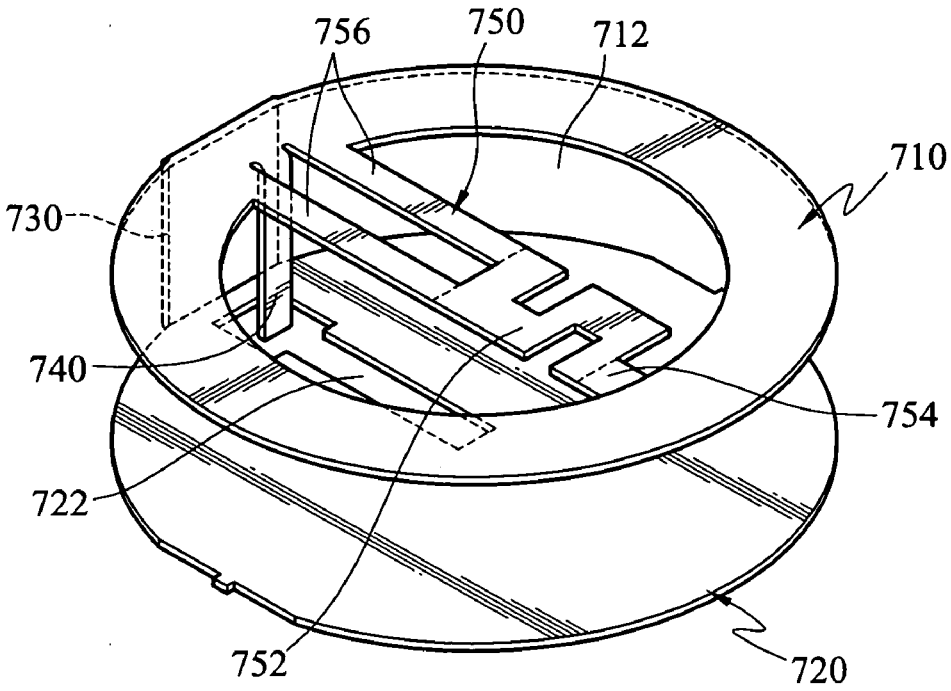
FIG. 7 is a perspective view of the PIFA according to a fifth embodiment of the invention.

Refer to FIG. 7 for the PIFA according to a fifth embodiment of the invention. It includes a ground portion 720, a short portion 730 and a feed section 740 that are substantially constructed as the ones set forth above, thus details are omitted, wherein the radiation portion 710 has a first opening 712, and the ground portion 720 has a second opening 722.

However, a radiation portion 710 has a first opening 712 connecting to a match portion 750 but which is larger than the match portion 750. The first opening 712 is near circular or other geometric shape larger than the match portion 750. The match portion 750 has two connecting portions 754 and 756 and a zigzag portion 752. That is, the zigzag portion 752 of the match portion 750 has two ends connecting respectively to one end of the connecting portions 754 and 756. The connecting portions 754 and 756 have other ends extended and connecting to two opposite sides of the first opening 712. The connecting portions 754 and 756 may be one or more metal conductors that are substantially rectangular or other geometric shapes. The connecting portion 754 may be a shorter metal conductor while the other connecting portion 756 is a longer metal conductor. The longer connecting portion 756 includes two metal conductors to allow the match portion 750 to securely connect to the radiation portion 710. In addition, the connecting portion 756 is connected to the radiation portion 710 where the short portion 730 is located. The other connecting portion 754 is connected to the opposite side.

Figure 8:
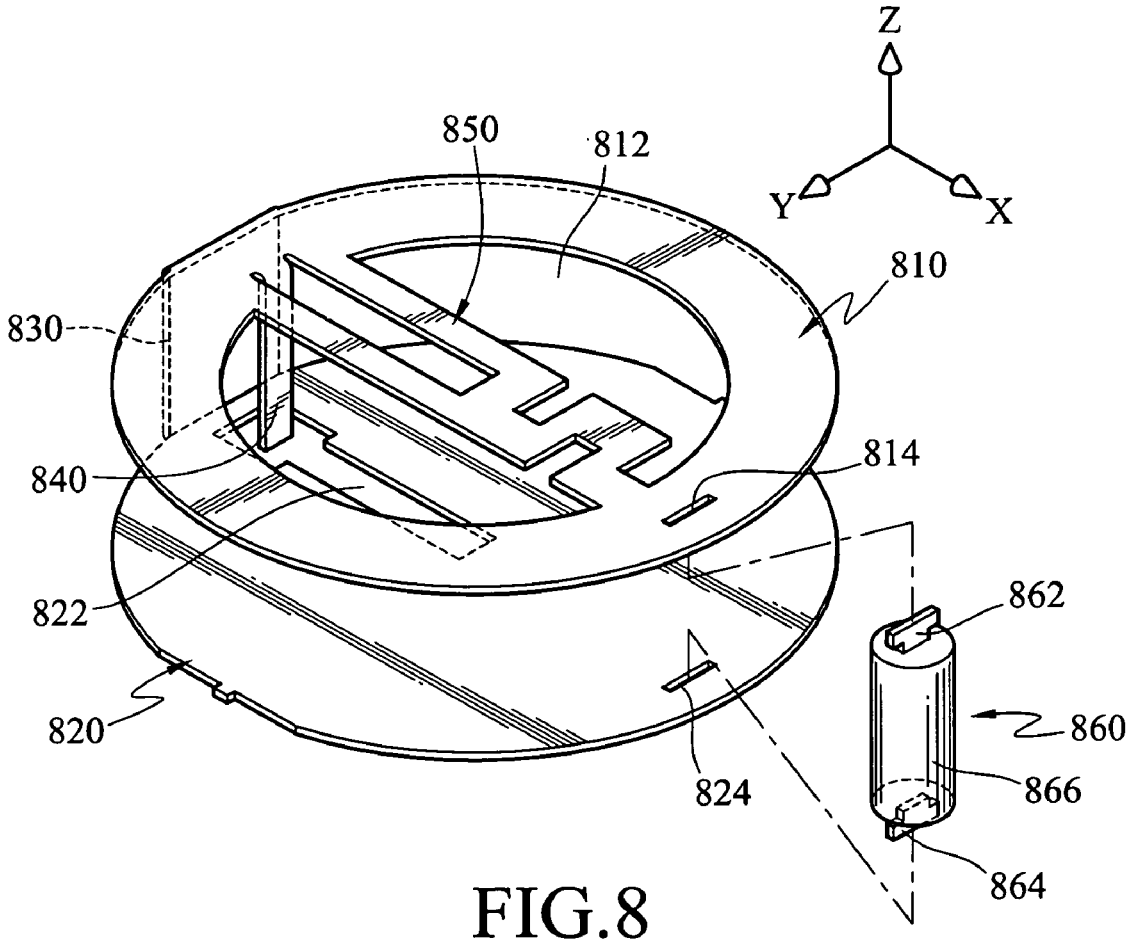
FIG. 8 is a perspective view of the PIFA according to a sixth embodiment of the invention.

Refer to FIG. 8 for the PIFA according to a sixth embodiment of the invention. It includes a radiation portion 810, a ground portion 820, a short portion 830 and a feed section 840 that are substantially constructed as the ones set forth above, thus details are omitted. In this case, the radiation portion 810 has a first opening 812, and the ground portion 820 has a second opening 822. It further includes a match portion 850 that is substantially constructed as the ones set forth above, thus details are omitted.

However, the PIFA further includes an anchoring portion 860 being a pillar made from an insulation material and having a length slightly greater than the short portion 830 to brace the radiation portion. The anchoring portion 860 includes two insetting portions 862 and 864, and a body 866. The two insetting portions 862 and 864 connect respectively to two ends of the body 866. The body 866 has a length about the same as the short portion 830. The radiation portion 810 and ground portion 820 may have a fourth opening 814 and a fifth opening 824 formed thereon for coupling with the two insetting portions 862 and 864 to brace the radiation portion 810 and space the radiation portion 810 from the ground portion 820 at a constant distance. The two insetting portions 862 and 864 may have a T-shaped structure with a top end to wedge respectively in the fourth and fifth openings 814 and 824 securely without loosening. Moreover, the fourth and fifth openings 814 and 824 may be located on one side of the radiation portion 810 and the ground portion 820 remote from the short portion 830. The body 866 is substantially a cylindrical or rectangular strut or a strut formed in other geometric shapes.

Figure 9:
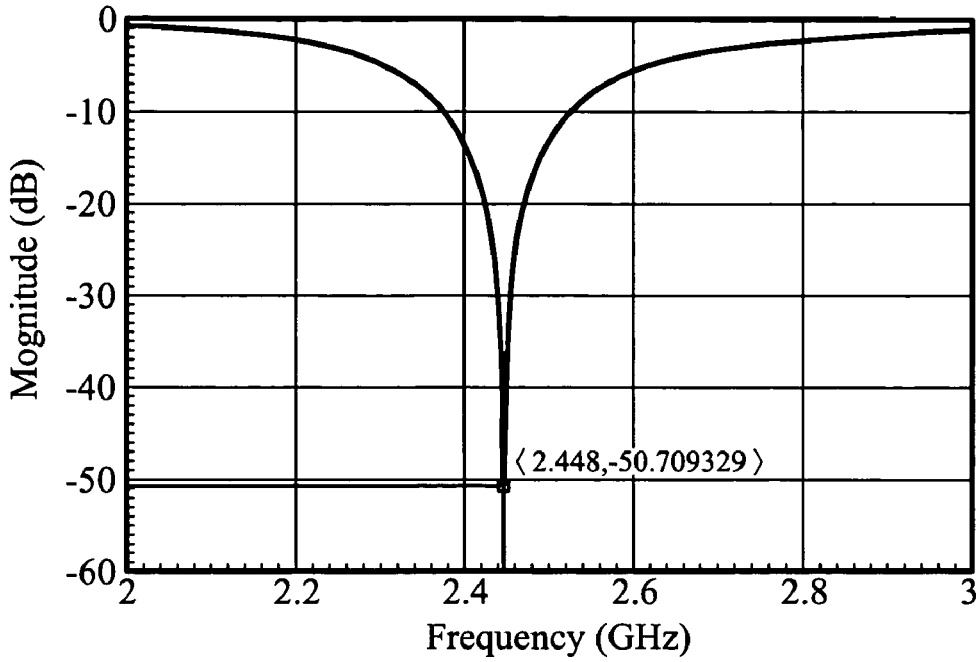
FIG. 9 is a chart showing the feed loss measurements of the PIFA according to a second embodiment of the invention.
Figure 10:
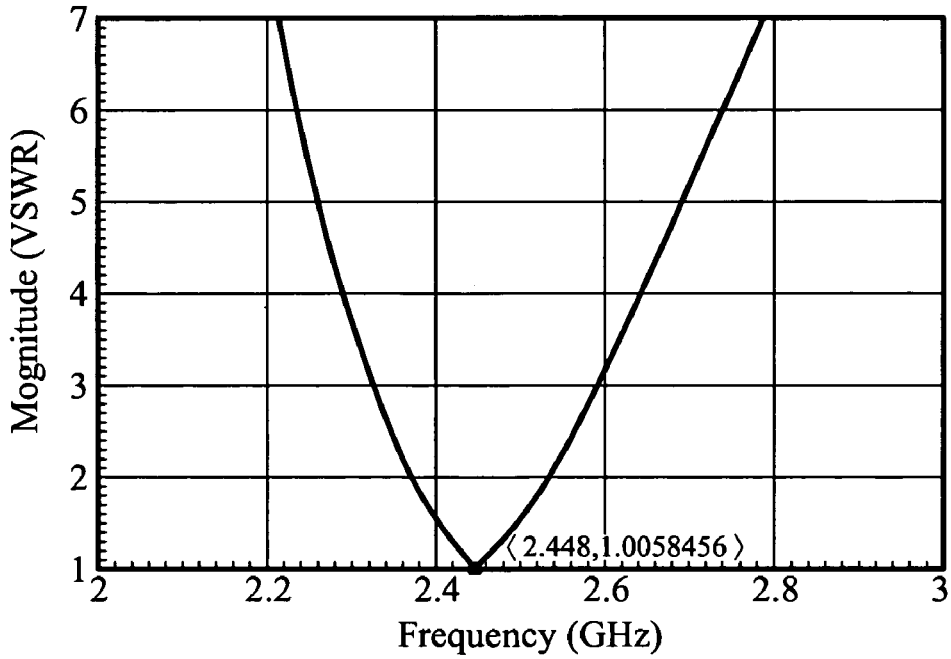
FIG. 10 is a chart showing the voltage stationary wave ratio measurements o of the PIFA according to a second embodiment of the invention.
Figure 11:
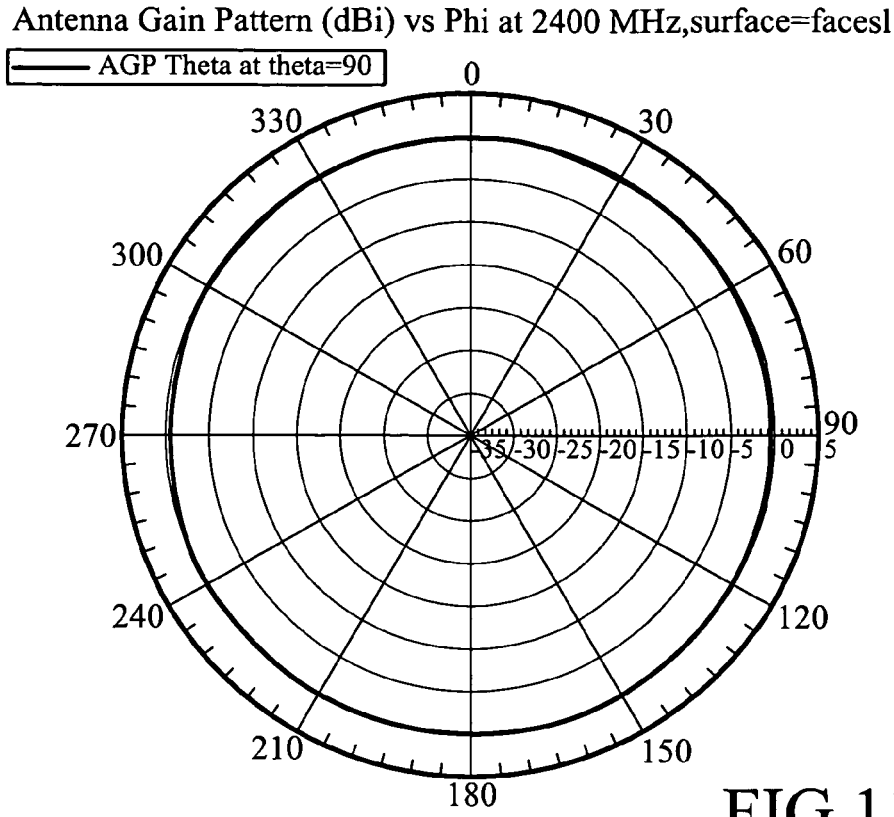
FIG. 11 is a chart showing the experimental measurements of the radiation field profile of θ (theta) polarization on an x-y plane when the second embodiment of the PIFA is adopted for 2.4 GHz.
Figure 12:
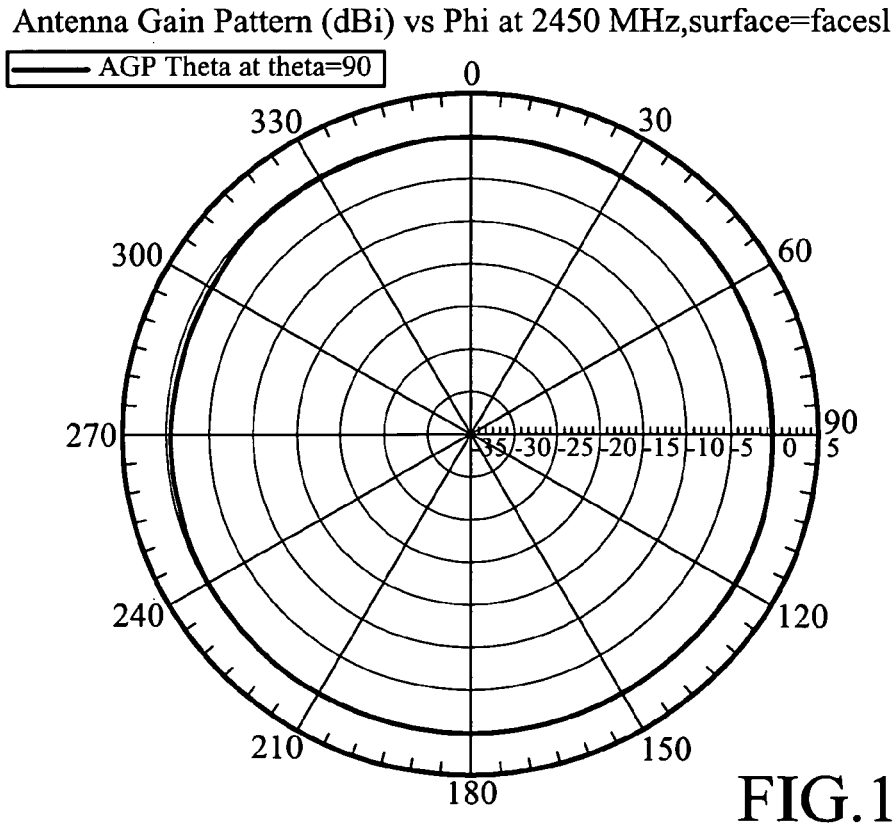
FIG. 12 is a chart showing the experimental measurements of the radiation field profile of θ (theta) polarization on an x-y plane when the second embodiment of the PIFA is adopted for 2.45 GHz.
Figure 13:
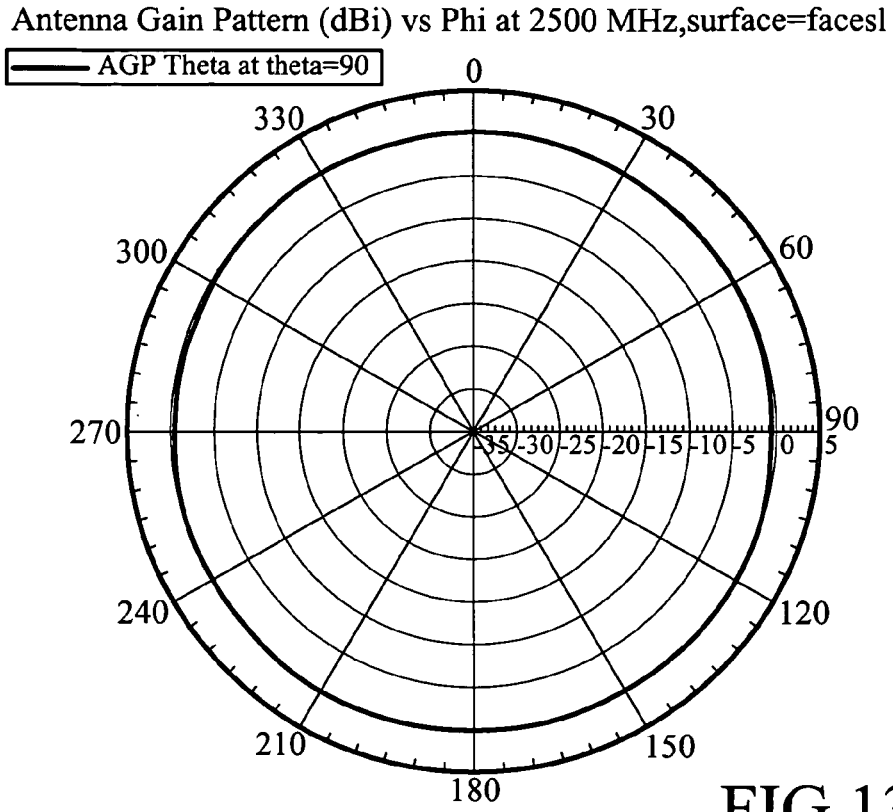
FIG. 13 is a chart showing the experimental measurements of the radiation field profile of θ (theta) polarization on an x-y plane when the second embodiment of the PIFA is adopted for 2.5 GHz.
Figure 14:
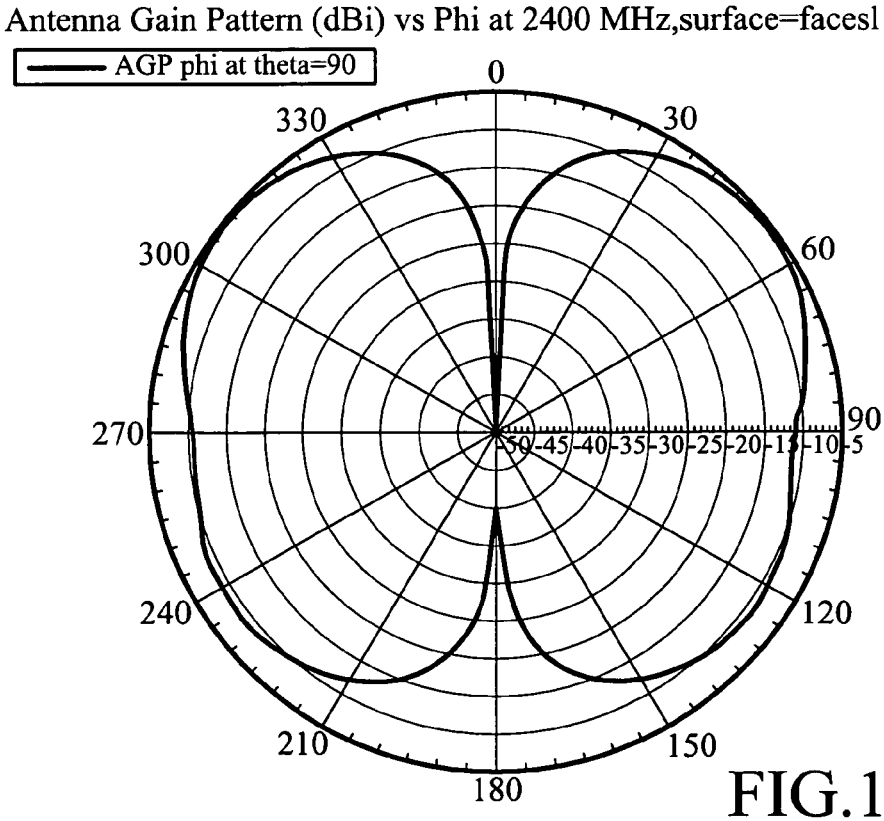
FIG. 14 is a chart showing the experimental measurements of the radiation field profile of ϕ (phi) polarization on an x-y plane when the second embodiment of the PIFA is adopted for 2.4 GHz.
Figure 15:
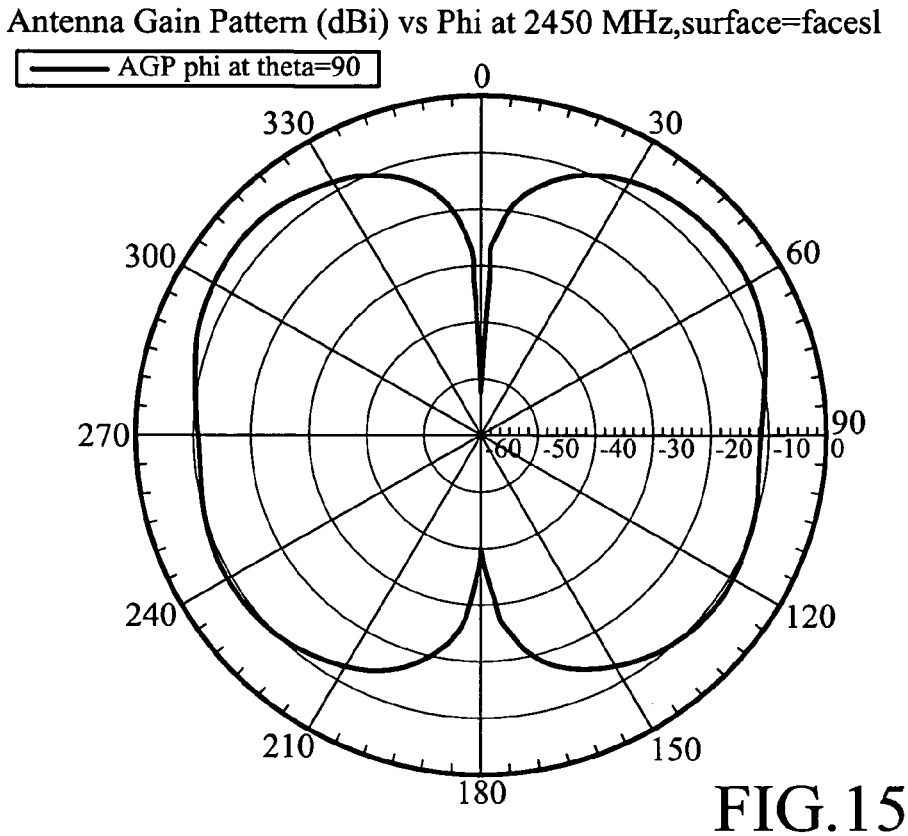
FIG. 15 is a chart showing the experimental measurements of the radiation field profile of ϕ (phi) polarization on an x-y plane when the second embodiment of the PIFA is adopted for 2.45 GHz.
Figure 16:
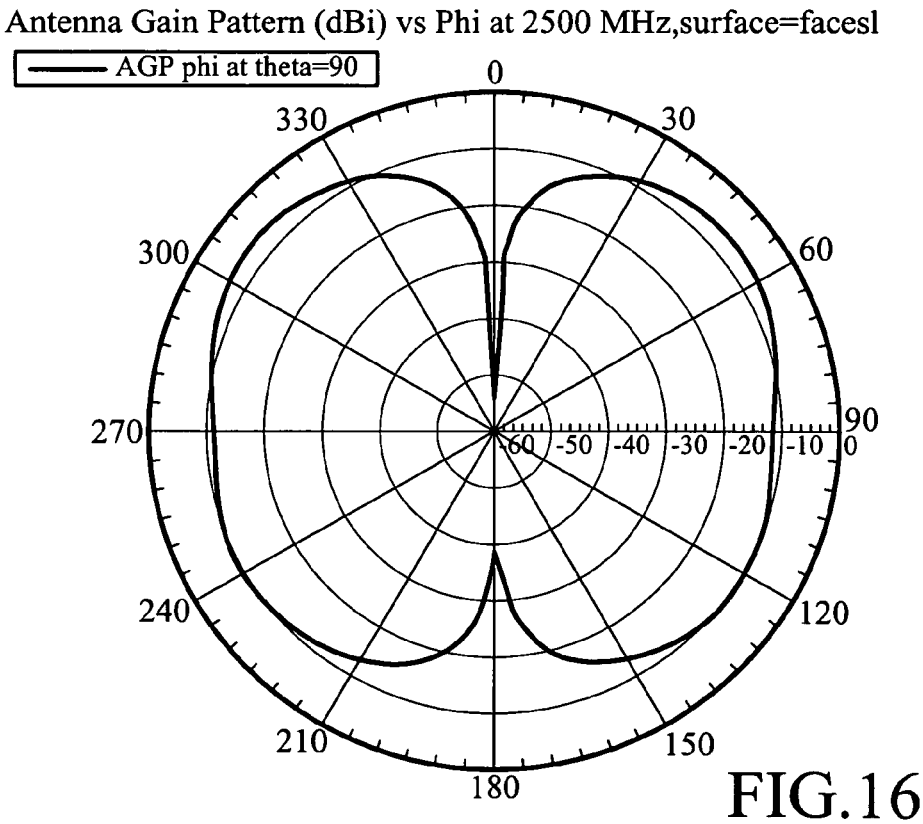
FIG. 16 is a chart showing the experimental measurements of the radiation field profile of ϕ (phi) polarization on an x-y plane when the second embodiment of the PIFA is adopted for 2.5 GHz.
Figure 17:
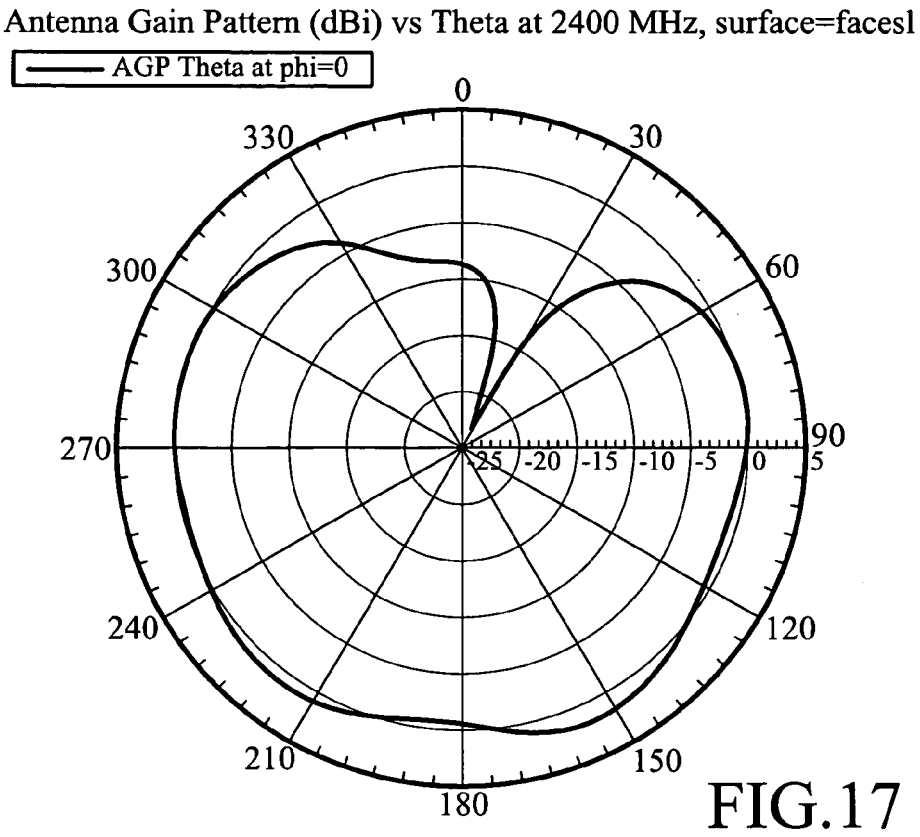
FIG. 17 is a chart showing the experimental measurements of the radiation field profile of θ (theta) polarization on an x-z plane when the second embodiment of the PIFA is adopted for 2.4 GHz.
Figure 18:
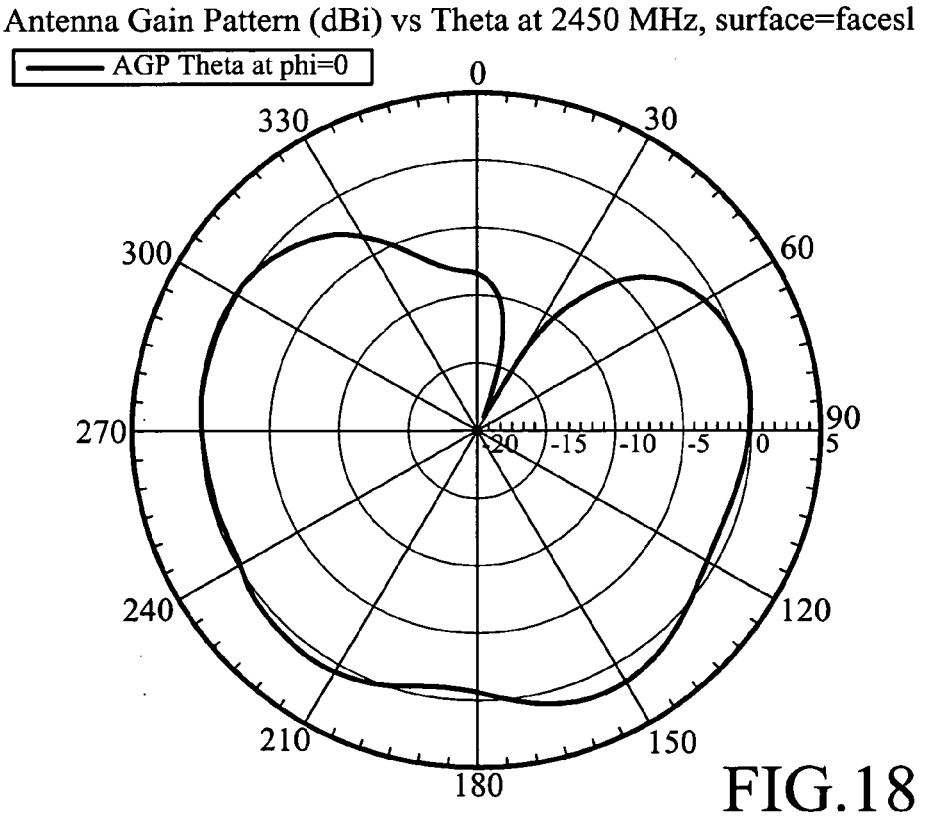
FIG. 18 is a chart showing the experimental measurements of the radiation field profile of θ (theta) polarization on an x-z plane when the second embodiment of the PIFA is adopted for 2.45 GHz.
Figure 19:
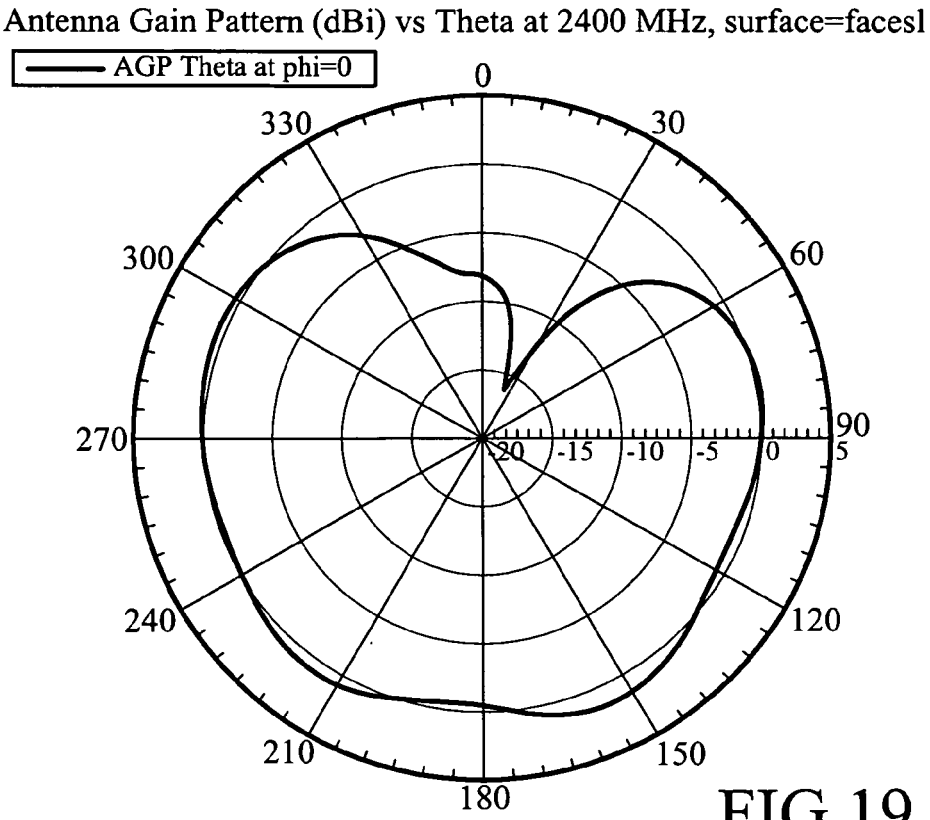
FIG. 19 is a chart showing the experimental measurements of the radiation field profile of θ (theta) polarization on an x-z plane when the second embodiment of the PIFA is adopted for 2.5 GHz.
Figure 20:
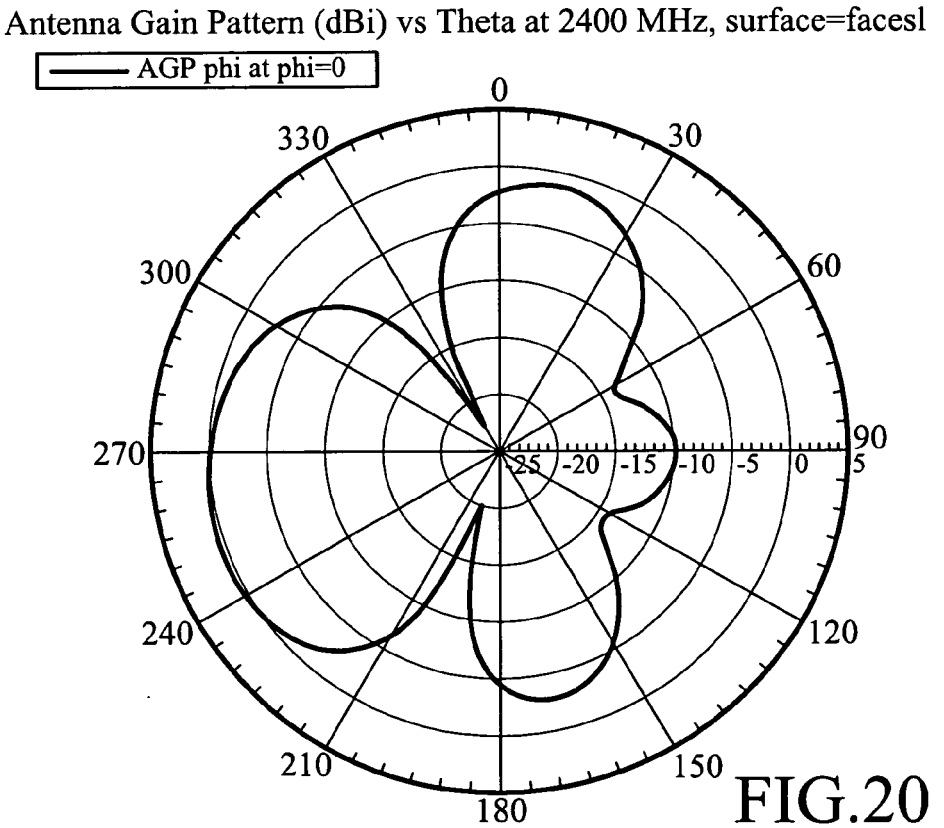
FIG. 20 is a chart showing the experimental measurements of the radiation field profile of ϕ (phi) polarization on an x-z plane when the second embodiment of the PIFA is adopted for 2.4 GHz.
Figure 21:
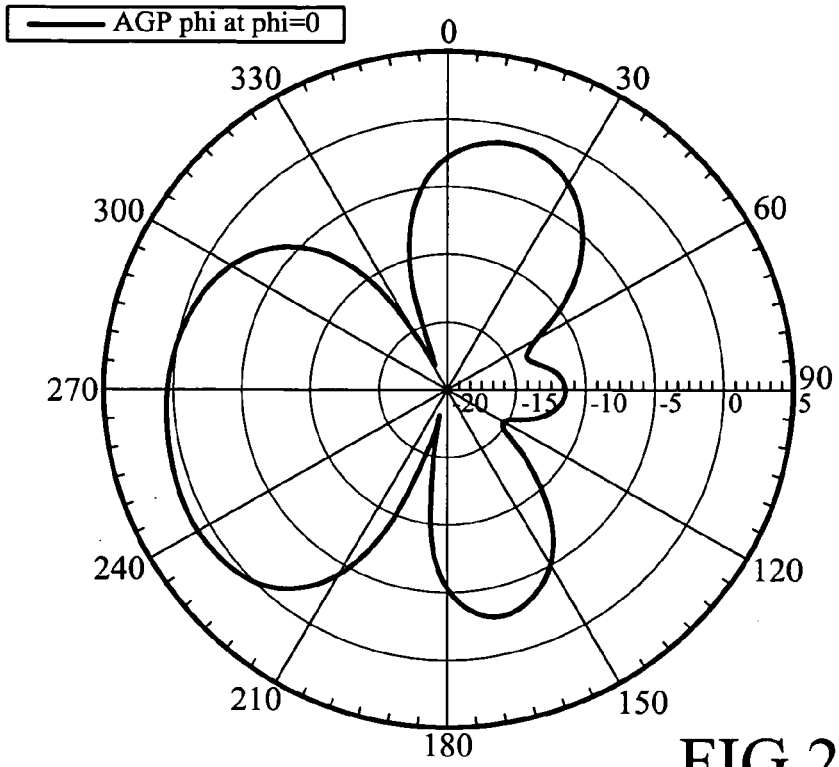
FIG. 21 is a chart showing the experimental measurements of the radiation field profile of ϕ (phi) polarization on an x-z plane when the second embodiment of the PIFA is adopted for 2.45 GHz.
Figure 22:
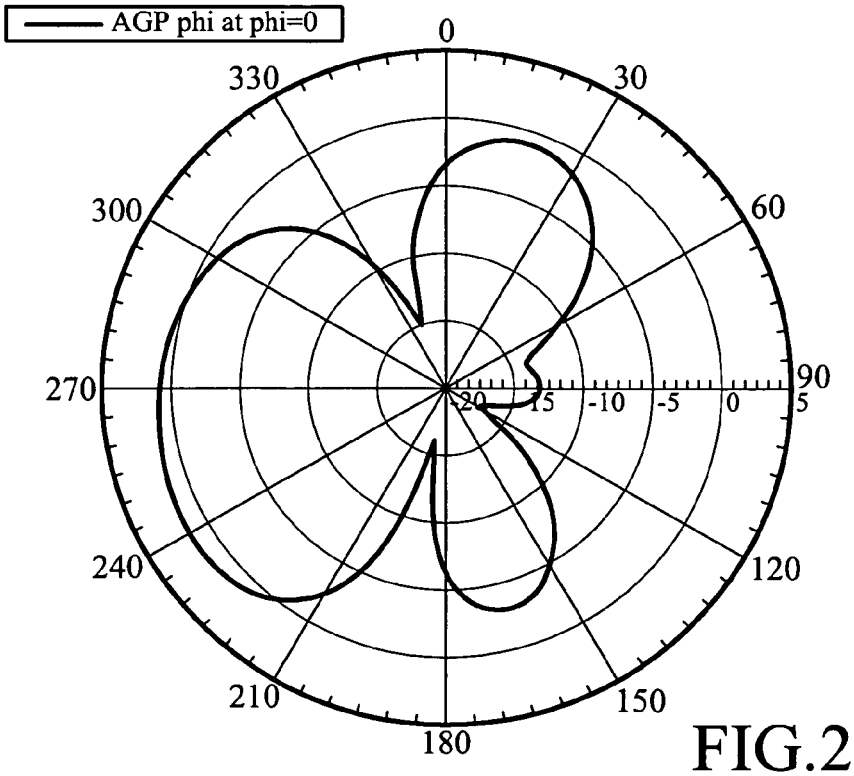
FIG. 22 is a chart showing the experimental measurements of the radiation field profile of ϕ (phi) polarization on an x-z plane when the second embodiment of the PIFA is adopted for 2.5 GHz.
Figure 23:
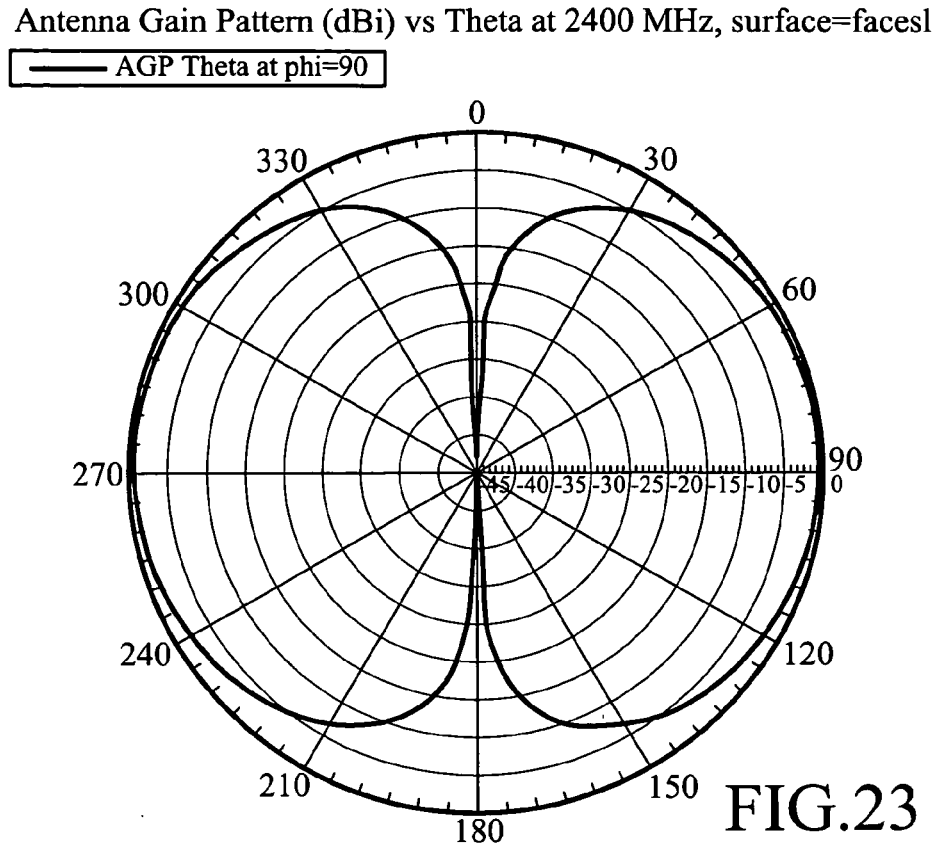
FIG. 23 is a chart showing the experimental measurements of the radiation field profile of θ (theta) polarization on a y-z plane when the second embodiment of the PIFA is adopted for 2.4 GHz.
Figure 24:
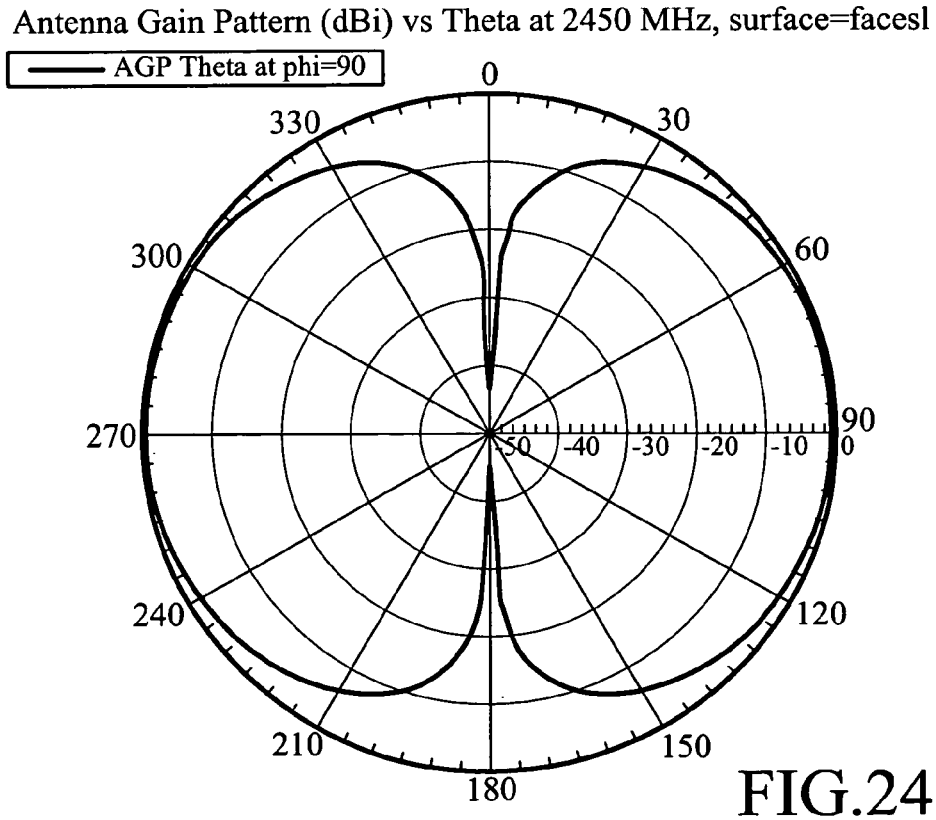
FIG. 24 is a chart showing the experimental measurements of the radiation field profile of θ (theta) polarization on a y-z plane when the second embodiment of the PIFA is adopted for 2.45 GHz.
Figure 25:
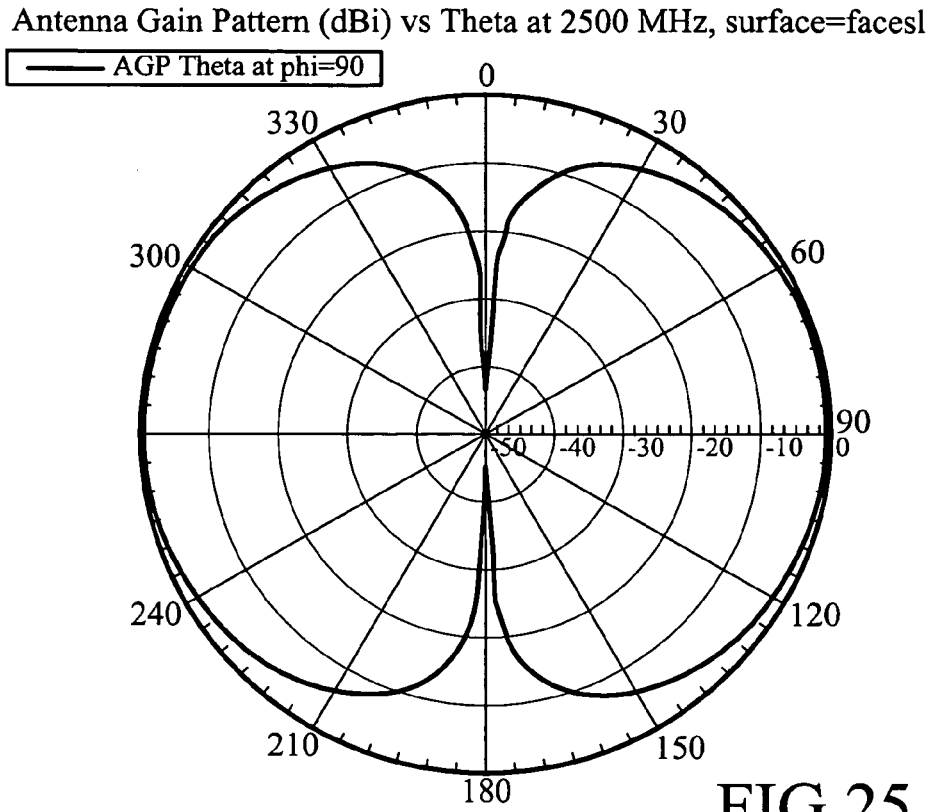
FIG. 25 is a chart showing the experimental measurements of the radiation field profile of θ (theta) polarization on a y-z plane when the second embodiment of the PIFA is adopted for 2.5 GHz.
Figure 26:
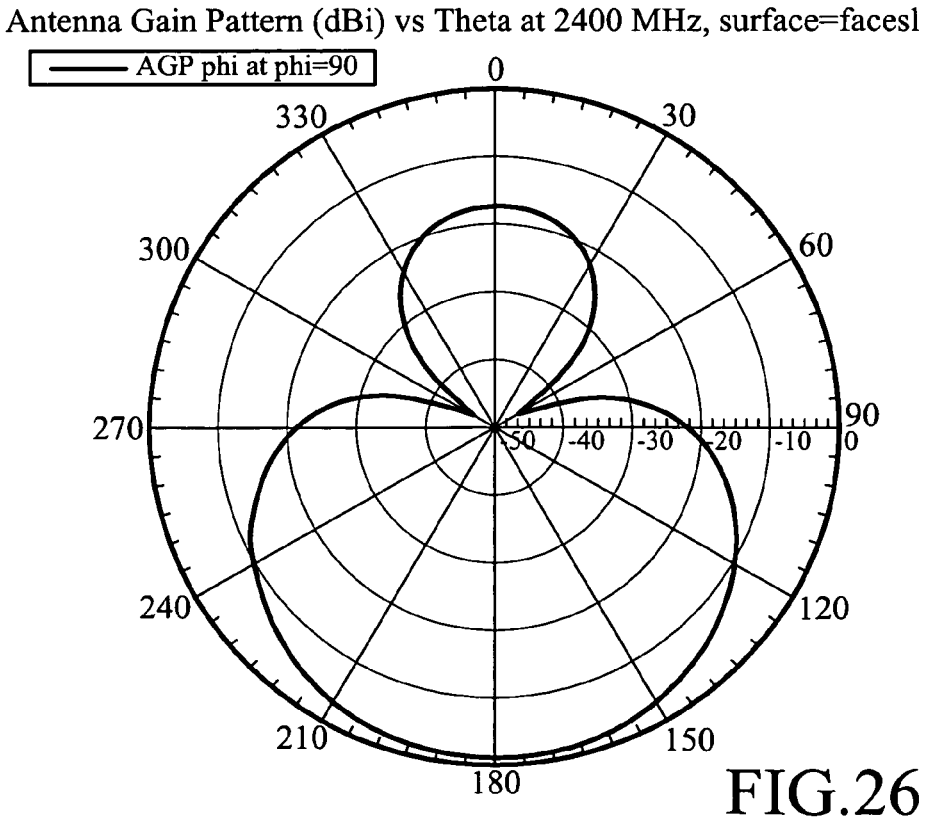
FIG. 26 is a chart showing the experimental measurements of the radiation field profile of ϕ (phi) polarization on a y-z plane when the second embodiment of the PIFA is adopted for 2.4 GHz.
Figure 27:
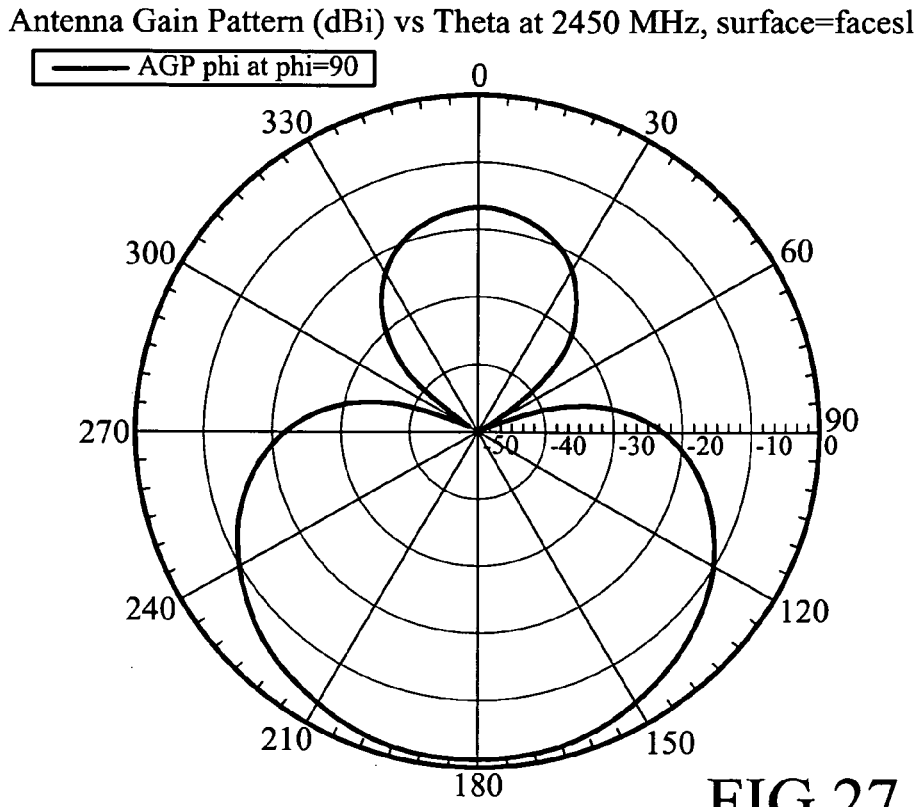
FIG. 27 is a chart showing the experimental measurements of the radiation field profile of ϕ (phi) polarization on a y-z plane when the second embodiment of the PIFA is adopted for 2.45 GHz.
Figure 28:
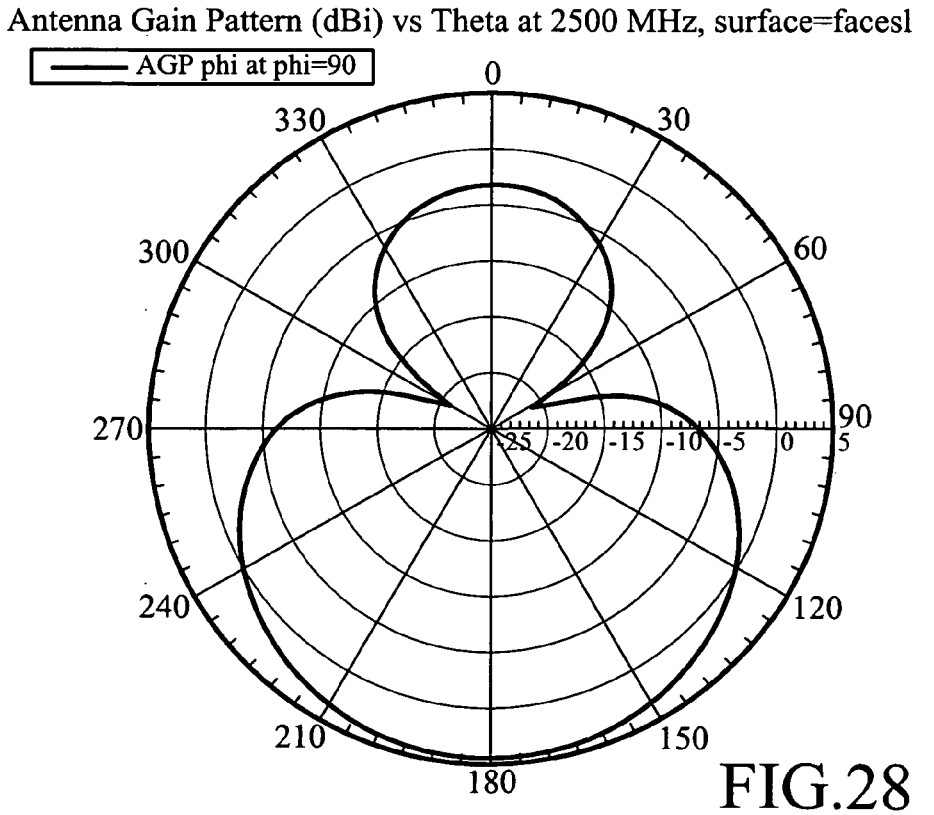
FIG. 28 is a chart showing the experimental measurements of the radiation field profile of ϕ (phi) polarization on a y-z plane when the second embodiment of the PIFA is adopted for 2.5 GHz.

Refer to FIGS. 9 through 28 for the actual test results of the feed loss, voltage stationary wave ratio and radiation field profile. FIGS. 9 and 10 show the measurements of the feed loss and the voltage stationary wave ratio in the frequency range of 2 GHz to 3 GHz, and then tests are performed for the radiation field profile on different planes and different polarizations at frequencies of 2.4 GHz, 2.45 GHz and 2.5 GHz. FIG. 11 shows the radiation field profile of θ (theta) polarization on an x-y plane when an embodiment of the PIFA is adopted for 2.4 GHz; the measured peak gain is −0.05 dBi. FIG. 12 shows the radiation field profile of θ (theta) polarization on an x-y plane when an embodiment of the PIFA is adopted for 2.45 GHz; the measured peak gain is 0.02 dBi. FIG. 13 shows the radiation field profile of θ (theta) polarization on an x-y plane when an embodiment of the PIFA is adopted for 2.5 GHz; the measured peak gain is 0.08 dBi. FIG. 14 shows the radiation field profile of ϕ (phi) polarization on an x-y plane when an embodiment of the PIFA is adopted for 2.4 GHz; the measured peak gain is −5.5 dBi. FIG. 15 shows the radiation field profile of ϕ (phi) polarization on an x-y plane when an embodiment of the PIFA is adopted for 2.45 GHz; the measured peak gain is −6.7 dBi. FIG. 16 shows the radiation field profile of ϕ (phi) polarization on an x-y plane when an embodiment of the PIFA is adopted for 2.5 GHz; the measured peak gain is −7.8 dBi. FIG. 17 shows the radiation field profile of θ (theta) polarization on an x-z plane when an embodiment of the PIFA is adopted for 2.4 GHz; the measured peak gain is 2.2 dBi. FIG. 18 shows the radiation field profile of θ (theta) polarization on an x-z plane when an embodiment of the PIFA is adopted for 2.45 GHz; the measured peak gain is 2.4 dBi. FIG. 19 shows the radiation field profile of θ (theta) polarization on an x-z plane when an embodiment of the PIFA is adopted for 2.5 GHz; the measured peak gain is 1.9 dBi. FIG. 20 shows the radiation field profile of ϕ (phi) polarization on an x-z plane when an embodiment of the PIFA is adopted for 2.4 GHz; the measured peak gain is −39 dBi. FIG. 21 shows the radiation field profile of ϕ (phi) polarization on an x-z plane when an embodiment of the PIFA is adopted for 2.45 GHz; the measured peak gain is −38.4 dBi. FIG. 22 shows the radiation field profile of ϕ (phi) polarization on an x-z plane when an embodiment of the PIFA is adopted for 2.5 GHz; the measured peak gain is −38 dBi. FIG. 23 shows the radiation field profile of θ (theta) polarization on a y-z plane when an embodiment of the PIFA is adopted for 2.4 GHz; the measured peak gain is −0.6 dBi. FIG. 24 shows the radiation field profile of θ (theta) polarization on a y-z plane when an embodiment of the PIFA is adopted for 2.45 GHz; the measured peak gain is −0.4 dBi. FIG. 25 shows the radiation field profile of θ (theta) polarization on a y-z plane when an embodiment of the PIFA is adopted for 2.5 GHz; the measured peak gain is −0.15 dBi. FIG. 26 shows the radiation field profile of ϕ (phi) polarization on a y-z plane when an embodiment of the PIFA is adopted for 2.4 GHz; the measured peak gain is −0.5 dBi. FIG. 27 shows the radiation field profile of ϕ (phi) polarization on a y-z plane when an embodiment of the PIFA is adopted for 2.45 GHz; the measured peak gain is −0.65 dBi. FIG. 28 shows the radiation field profile of ϕ (phi) polarization on a y-z plane when an embodiment of the PIFA is adopted for 2.5 GHz; the measured peak gain is −0.45 dBi.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A planar inverted F antenna, comprising:

a radiation portion receiving/transmitting signals, wherein the radiation portion has a first opening and a match portion located in the first opening, the match portion having two ends connected to the radiation portion, and the first opening being larger than the match portion;

a short portion having one end connected to the radiation portion to brace the radiation portion;

a ground portion connecting to the short portion on another end thereof; and a feed section located between the radiation portion and the ground portion and the feed section, the feed section having one end connected to the radiation portion and another end directed towards the ground portion without connecting to the ground portion.

2. The planar inverted F antenna of claim 1, wherein the match portion includes:

two connecting portions, each connecting portion having one end connected to the radiation portion; and a zigzag portion having two ends connected respectively to another ends of the connecting portions.

3. The planar inverted F antenna of claim 2, wherein the connecting portions and the zigzag portion are formed with a conductive thin metal sheet.

4. The planar inverted F antenna of claim 2, wherein each of the connecting portions is at least one metal conductor.

5. The planar inverted F antenna of claim 4, wherein each of the connecting portions is formed in a geometric shape.

6. The planar inverted F antenna of claim 5, wherein each of the connecting portions is formed in a substantially rectangular shape.

7. The planar inverted F antenna of claim 1, wherein the radiation portion has a symmetrical first opening.

8. The planar inverted F antenna of claim 7, wherein the radiation portion has a slit on one side opposite of the short portion.

9. The planar inverted F antenna of claim 7, wherein the shape of the symmetrical first opening is substantially circular.

10. The planar inverted F antenna of claim 1, wherein the radiation portion, the short portion, the ground portion and the feed section are formed with a conductive thin metal sheet.

11. The planar inverted F antenna of claim 1, wherein the radiation portion, the short portion, the ground portion and the feed section are each formed in a geometric shape.

12. The planar inverted F antenna of claim 11, wherein the radiation portion and the ground portion are substantially circular of the same shape.

13. The planer inverted F antenna of claim 1, wherein the radiation portion, the short portion, the ground section are integrally formed.

14. A planar inverted F antenna, comprising:

a radiation portion receiving/transmitting signals, wherein the radiation portion has a first opening and a match portion located in the first opening, the match portion having two ends connected to the radiation portion, and the first opening being larger than the match portion;

a short portion having one end connected to the radiation portion to brace the radiation portion;

an anchoring portion being a pillar, formed with an insulation material and having a length greater than the short portion, to brace the radiation portion;

a ground portion connected to the short portion on another end thereof; and a feed section located between the radiation portion and the ground portion and the feed section, the feed section having one end connected to the radiation portion and another end directed towards the ground portion without connecting to the ground portion, wherein the ground portion has a second opening corresponding to the feed section, the second opening being larger than the feed section, and the short portion having a third opening.

15. The planar inverted F antenna of claim 14, wherein the anchoring portion includes:

a body being a pillar having a length substantially the same as a length of the short portion; and two insetting portions respectively setting in two ends of the body for insetting into the radiation portion.

16. The planar inverted F antenna of claim 15, wherein the radiation portion and the ground portion have respectively a fourth opening and a fifth opening, to couple respectively with the insetting portions.

17. The planar inverted F antenna of claim 16, wherein the fourth opening and the fifth opening are located respectively on one side of the radiation portion and the ground portion remote from the short portion.

18. The planar inverted F antenna of claim 15, wherein the body is a pillar of a geometric shape.

19. The planar inverted F antenna of claim 18, wherein the body is substantially a circular pillar.

20. A planar inverted F antenna, comprising:

a radiation portion receiving/transmitting signals, wherein the radiation portion has a first opening and a match portion located in the first opening, the match portion having two ends connected to the radiation portion, and the first opening being larger than the match portion;

a short portion having one end connected to the radiation portion to brace the radiation portion;

a ground portion connected to the short portion on another end thereof; and a feed section located between the radiation portion and the ground portion, the feed section having one end connected to the radiation portion and another end directed toward the ground portion without connecting to the ground portion, wherein the ground portion has a second opening corresponding to the feed section, the second opening being larger than the feed section.

21. The planar inverted F antenna of claim 20, wherein the feed section runs through the second opening beyond the surface of the ground portion.

22. The planar inverted F antenna of claim 21, wherein the feed section has a jutting end extending beyond the surface of the ground portion, the jutting end having a width smaller than a width of the feed section.

23. A planar inverted F antenna, comprising:

a radiation portion receiving/transmitting signals, wherein the radiation portion has a first opening and a match portion located in the first opening, the match portion having two ends connected to the radiation portion, and the first opening being larger than the match portion;

a short portion having one end connected to the radiation portion to brace the radiation portion;

a ground portion connected to the short portion on another end thereof; and a feed section located between the radiation portion and the ground portion, the feed section having one end connected to the radiation portion and another end directed toward the ground portion without connecting to the ground portion, wherein the ground portion has a second opening corresponding to the feed section, the second opening being larger than the feed section, and wherein the short portion has a third opening.

24. The planar inverted F antenna of claim 23, wherein the third opening divides the short portion into two sections, each of the sections having one end connected to the radiation portion and another end connected to the ground portion.

25. The planar inverted F antenna of claim 23, wherein the third opening is formed in at least one of a triangular, rectangular, circular, square, elliptical and rhombic shape.

26. The planar inverted F antenna of claim 25, wherein the third opening is a slot.

* * * * *